US006401589B1

(12) United States Patent
Pinkus et al.

(10) Patent No.: US 6,401,589 B1
(45) **Date of Patent: *Jun. 11, 2002**

(54) LIMITING AIRBORNE TARGET DESIGNATING LASER CANOPY RETURNS

(75) Inventors: Alan R. Pinkus, Bellbrook; Harry L. Task, Dayton; Peter L. Marasco, Kettering, all of OH (US)

(73) Assignee: The United States of America as represented by the Secretary of the Air Force, Washington, DC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/501,290

(22) Filed: Feb. 9, 2000

(51) Int. Cl.[7] ..... F41F 5/00
(52) U.S. Cl. ..... 89/1.1
(58) Field of Search ..... 244/129.3; 89/1.11

(56) References Cited

U.S. PATENT DOCUMENTS

| | | | | | |
|---|---|---|---|---|---|
| 3,618,881 | A | * | 11/1971 | Fellers et al. | 244/121 |
| 4,618,224 | A | * | 10/1986 | Smith | 359/841 |
| 4,677,288 | A | * | 6/1987 | Smith | 250/216 |
| 4,749,261 | A | | 6/1988 | McLaughlin et al. | |
| H979 | H | * | 11/1991 | Kelley | 244/129.3 |
| 5,276,693 | A | | 1/1994 | Long et al. | |
| 5,657,161 | A | * | 8/1997 | Melograne | 359/501 |
| 5,729,010 | A | | 3/1998 | Pinkus et al. | |
| 5,739,950 | A | | 4/1998 | Wood et al. | |
| 5,747,792 | A | | 5/1998 | Kintz et al. | |
| 5,751,380 | A | | 5/1998 | Hanssen | |
| 5,756,989 | A | | 5/1998 | Bear et al. | |
| 5,790,209 | A | | 8/1998 | Engelhardt et al. | |
| 5,793,450 | A | | 8/1998 | Engelhardt et al. | |
| 5,828,437 | A | | 10/1998 | Hubert-Harbart et al. | |
| 6,028,724 | A | * | 2/2000 | Leib | 359/886 |
| 6,042,239 | A | * | 3/2000 | Liepmann et al. | 359/601 |

* cited by examiner

*Primary Examiner*—Charles T. Jordan
*Assistant Examiner*—Jordan M. Lofdahl
(74) *Attorney, Agent, or Firm*—Gerald B. Hollins; Thomas L. Kundert

(57) ABSTRACT

A laser energy window arrangement especially usable in a tactical aircraft having night vision equipment-aided cockpit visual information input requirements. The laser energy window arrangement enables use of laser apparatus directed external to the aircraft for target designation or other purposes while minimizing the amount of energy from such laser returning spuriously inside the cockpit where it inherently acts a noise signal for night vision equipment. The laser energy window limits the portion of the aircraft windshield or canopy exposed to laser radiation and its effects to a relatively small area, an obscurable area generating significantly reduced amounts of spurious return energy in comparison with use of the laser directly through an unlimited windshield, canopy, or other type of transparency. Transmission of spurious return energy from the laser energy window to remaining portions of the windshield or canopy is precluded by interruption of transmission paths within the windshield or canopy material and transducing the interrupted path energy into heat dissipated within or outside of the aircraft and not affecting the remainder of the canopy. Potentially increased aircraft to target standoff range, reduce need for aircrew use of laser eye protection gear, reduced laser induced windshield or canopy degradation and other benefits are identified for aircraft uses of the invention. Use of the window invention in other non aircraft and non military aircraft settings is also contemplated.

15 Claims, 5 Drawing Sheets

LIMITING AIRBORNE TARGET DESIGNATING LASER CANOPY RETURNS

RIGHTS OF THE GOVERNMENT

The invention described herein may be manufactured and used by or for the Government of the United States for all governmental purposes without the payment of any royalty.

BACKGROUND OF THE INVENTION

This invention relates to the field of reducing radiant energy noise signals arising from laser use, for example, target designating laser use, within the cockpit of a military aircraft. The invention supports concuteat operation of such lasers with night vision equipment and visual flight practices.

According to current states of the warfare and technical arts combat aircraft crewmembers often use portable infrared lasers to designate certain classes of ground targets for munitions reception. In this practice a crewmember holds a target designating laser by hand and in the case of a single crew member tactical aircraft, simultaneously flies the aircraft. This activity is often accomplished while also wearing both night vision goggles and laser eye protection apparatus. Currently, low power infrared lasers are often used for such target designation purposes. A desirable increase in aircraft to target standoff range and other advantages can however be realized through use of more powerful lasers in this service. Current target designating lasers are largely of the solid state type; with use of the instant invention however, a spurious laser energy return phenomenon and a resulting night vision difficulty, which presently limit the desirability of higher powered lasers as target designators, are eliminated and higher powered lasers and possibly gaseous lasers become more attractive for target designation.

A difficulty encountered with both current and such contemplated future use of this target designating practice originates in the fact that materials used in aircraft canopies when acting as a laser energy transmitting medium are not free of energy losses and attending complexities. In fact, canopy materials when acting as a laser light conduit tend to produce a significant veiling canopy glow phenomenon. The canopy glow phenomenon arises from internal imperfections (particulate inclusions and bubbles) found within the canopy material and from exterior surface imperfections (such as scratches, abrasions and sand or stone impact marks) on the canopy surface. The canopy glow phenomenon is thus primarily due to imperfection-induced total internal reflections and Fresnel internal reflections causing a conduit effect loss over a significant part of the canopy surface. This veiling canopy glow or canopy glow-sourced radiant energy may be considered an infrared noise signal and significantly interferes with the aircraft crew's out-of-cockpit night vision goggle-aided vision; the vision needed for aircraft flight control and for target acquisition and designation. In general the veiling canopy glow causes excessive signal input, blooming and distant object hiding effects in the night vision equipment and increases in severity as laser power increases. Usually however this canopy glow is not accompanied by direct or first order heat effects since the laser energy involved preferably resides in the short rather than long infrared wavelength part of the electromagnetic spectrum. Laser light from the target designator also can bounce around the aircraft cockpit and necessitate the crewmembers wearing laser eye protection gear. This same laser eye protection gear can however reduce night vision goggle visual performance.

SUMMARY OF THE INVENTION

The present invention provides reduced spurious radiant energy returns from the interior and exterior portions of transparent optical materials used to close aircraft fuselage openings when these materials are energized by a high energy source of radiation such as a laser. The invention is particularly useful in the case of target designation by portable laser from within a night vision system-equipped tactical military aircraft cockpit.

It is an object of the present invention therefore, to enhance the night operation capability of a military aircraft.

It is another object of the invention to enable night vision system-compatible usage of a laser target designating apparatus in an aircraft cockpit.

It is another object of the invention to reduced energy reflections, veiling canopy glow and other spurious energy returns encountered during use of a laser target designating apparatus in an aircraft cockpit.

It is another object of the invention to provide a laser window apparatus of low spurious energy return characteristics.

It is another object of the invention to simplify the use of higher power target designating lasers within an aircraft cockpit.

It is another object of the invention to provide an uninterrupted flow of visual information to a pilot or air crew member during operation of a laser target designating apparatus.

It is another object of the invention to preclude age degradation effects attending laser energy transmission through the materials of an aircraft canopy.

It is another object of the invention to provide an easily replaced canopy region usable for laser energy transmission from an aircraft.

It is another object of the invention to limit the laser related effects of aircraft windshield defects.

It is another object of the invention to limit or eliminate a significant source of night vision apparatus saturation and recovery time effects in an aircraft cockpit.

It is another object of the invention to attenuate the total internal reflection, Fresnel reflection and scatter related effects accompanying laser energy transmission through transparent materials.

It is another object of the invention to attenuate the laser illuminated effects of material defects such as bubbles, particulate inclusions and surface defects in aircraft windshield or canopy materials.

It is another object of the invention to reduce laser eye damage possibilities in the cockpit of an aircraft.

It is another object of the invention to enhance the aircraft to target standoff distance capability of a laser inclusive airborne military weapons system.

It is another object of the invention to enable the increased standoff range between a target designating aircraft and its target by increased laser operating power levels.

It is another object of the invention to enable the use of differing laser types and differing operating wavelengths in target designating apparatus.

It is another object of the invention to enable the use of lasers of differing spectral capability and energy level in aircraft target designator apparatus.

It is another object of the invention to provide a plurality of physical arrangements usable in disposing a laser window apparatus in an aircraft and its transparency.

It is another object of the invention to provide a laser window apparatus usable in a variety of aircraft windshield and canopy arrangements.

It is another object of the invention to provide reduced infrared signature from the cockpit of an aircraft during use of cockpit laser apparatus.

It is another object of the invention to increase the effectiveness of hand held lasers used by combat aircraft crews to designate certain ground targets.

It is another object of the invention to provide enhanced visibility of an aircraft-sourced laser target designation from other aircraft.

It is another object of the invention to compensate for the effects of canopy wear (such as abrasions, scratches and so-on) on the use of laser target designation.

These and other objects of the invention are achieved by laser path window apparatus comprising the combination of:

a first radiant energy transmission member having radiant energy transmission capability in both thickness first and thickness-orthogonal second directions;

a second radiant energy transparent member physically smaller in said thickness-orthogonal direction than said first optically transparent member and having loss-inclusive radiant energy transmission capability in both thickness and thickness-orthogonal directions;

said second radiant energy transparent member being coplanar received in a to selected thickness-orthogonal direction region of said first radiant energy transmission member;

a laser member having radiant output energy directed through said second radiant energy transparent member in said thickness direction;

said loss inclusive radiant energy transmission capability in said second radiant energy transparent member generating, from said thickness direction-oriented laser radiant output energy, energy loss portions having a thickness-orthogonal direction component of orientation;

a geometrically closed radiant energy containment member surrounding said smaller second radiant energy transparent member in said thickness-orthogonal direction and interrupting said radiant energy loss portions having a thickness-orthogonal direction component of orientation intermediate said smaller second radiant energy transparent member and said surrounding first radiant energy transmission member;

said interrupting and said geometrically closed radiant energy containment member limiting radiant energy loss portion-sourced spurious energy emissions from said laser path window apparatus to occurrence in portions of said second radiant energy transparent member in exclusion of said first radiant energy transmission member.

DETAILED DESCRIPTION

Laser based target marking has been accomplished through the use of hand-held laser target-designating devices, devices often located within the cockpit of an aircraft operating at night while the pilot is wearing night vision goggles (NVGs). These target designators are often directed at the target through the windshield or canopy of the designator aircraft. Such direction through the windshield or canopy can, however, be accompanied by certain real world practical technical difficulties. This is an area of interest for military embodiments of the present invention. Currently, low power infrared lasers, lasers visible to night vision goggle apparatus are used in these target marking applications however an increase in aircraft-to-target stand-off range could be realized with the use of more powerful lasers if certain presently considered optical noise technical difficulties were not present.

Figures 7, 7A, 7B:
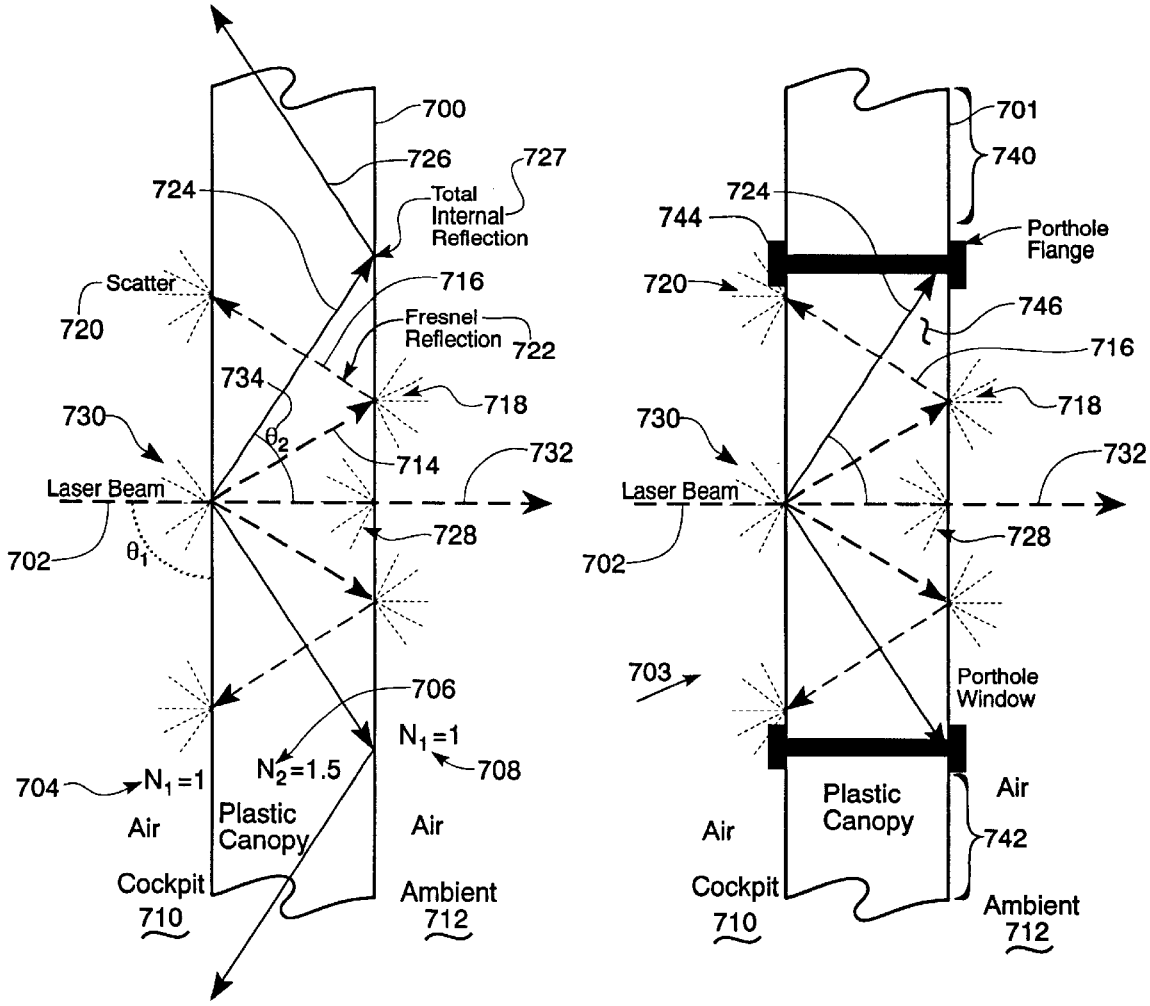
FIG. 7*a* shows a cross sectional representation of a FIG. 1 and FIG. 2 canopy and the veiled . canopy glow-related radiant energy paths expected in the canopy material.
FIG. 7*b* shows a cross sectional representation of the FIG. 3 canopy and the improved radiant energy paths incurred therein.

These technical difficulties include a veiling canopy glow phenomenon resulting from light transmission through aircraft canopy materials. This veiling canopy glow phenomenon is believed to arise from a combination of effects, that is from optical phenomenon encountered in ideal optical conductors and also from imperfections encountered in many optical conductors. The first of these effects includes the phenomena of total internal reflection, Fresnel reflection and scatter as are illustrated in FIG. 7 of the drawings herein and the second effect is attributed to such real world occurrences as particulate inclusions and bubbles within the material of the aircraft canopy and to exterior canopy surface imperfections such as scratches, abrasions and sand or stone impact markings. The veiling canopy glow phenomenon is especially undesirable for a military aircraft because of the effect the glow has on the night vision equipment often used in such aircraft and because the glow may also enhance the signature of the aircraft from both a signature spectrum and a signature intensity perspective and thereby make the aircraft more vulnerable to enemy action.

FIG. 7*a* in the drawings therefore, shows a cross-section of a plastic aircraft canopy 700 communicating a laser beam 702 from a cockpit side 710 to an outside or ambient side 712 of the canopy. The canopy-emerging laser beam 732 in FIG. 7*a* is attenuated with respect to the input beam 702 by the canopy glow phenomenon-related loss mechanisms of Fresnel reflection represented at 722 plus the resulting scatter emissions represented for example at 718 and 720 and by the total internal reflection losses represented at 724, 726 and 727 for example. Additional FIG. 7 scatter losses are represented at 728 and 730 where the entrance and exit laser beams intercept materials of differing index of refraction. In this regard the canopy 700 is presumed to have an index of refraction $N_2$, 706, of magnitude 1.5 and this is interfaced on either side by air of index $N_1$ of magnitude of 1.0 as represented at 704 and 708.

If the canopy 700 in FIG. 7 were perfect with no defects there would be no scatter of the input energy and no generation of the interfering glow; i.e., there would be no angle at which the laser beam 702 could enter the canopy material that could cause internal reflection. Since, however, there are defects present in the canopy material the beam 702 can enter at angles that result in reflection. Depending upon these scatter angles, entering light is either reflected or totally internally reflected with the resultant canopy glow which causes degradation of the night vision goggles operation.

Snell's Law, Equation 1 shown below, describes factors governing the FIG. 7*a* example and determines whether beam losses are totally internally reflected or Fresnel reflected in nature. The critical value, $\theta_c$, for the angle $\theta_2$, at 734, is determined from Equation 1 using a $\theta_1$ value of 90 degrees. When the angle $\theta_2$ at 734 equals or exceeds the critical angle as determined by Equation 2, the beam will be totally internally reflected at the next point of incidence.

$$N_1 \sin \theta_1 = N_2 \sin \theta_2 \quad \text{(Eq. 1)}$$

Where:

$N_1$=1.0 index of refraction for air $N_2$=index of refraction for aircraft canopy plastics ≈1.49 to 1.56

$\theta_1$=laser beam angle of incidence $\theta_2$=angle of refraction inside the medium $$\theta_c = \sin^{-1}(1/N_2) \quad \text{(Eq. 2)}$$

Where:

$\theta_c$=the critical value for the $\theta_2$ angle of refraction inside the medium The canopy glow resulting from such mechanisms interferes with the pilot's out-of-cockpit night vision goggle visibility, the visibility needed for flight and for target acquisition and designation. As a result of the veiling canopy glow mechanisms laser light also can bound around the aircraft cockpit where it may reflect from appropriate surfaces and enter either the night vision goggle input port or directly enter the pilot's eyes. This is one reason why a pilot usually wears a laser eye protection device in addition to night vision goggle apparatus. Laser eye protection can, however, reduce the visual performance of a night vision goggle. The canopy glow only further degrades visibility. The present invention optically isolates the laser light from a major portion of the aircraft canopy thus allowing increased laser power usage while yet maintaining out-of-cockpit visibility for the pilot.

The invention therefore relates to a device and a procedure allowing effective use of high-powered infrared lasers, as they are directed through the side or other area of an aircraft canopy for use as target designators or for other possible uses. Such use of canopy materials has however often heretofore caused the canopy material and therefore significant portions of the canopy structure to become radiant energy-emitting or to glow. Generally the stronger the laser, the greater the amount of veiling canopy glow observed.

The present invention relieves this difficulty with canopy glow through provision of a canopy portion affording optical isolation from the remainder of the canopy. With this improvement laser output energy coupling to the remaining larger portion of the canopy is eliminated. Such improvement enables the use of increased laser power and enhances the night vision goggle visibility obtained from the cockpit. Other benefits include increased laser eye safety within the cockpit, lowered infrared signature emanating from the cockpit (and therefore reduced vulnerability of the designator aircraft to missile lock-on for example), greater stand-off slant range between the target designator aircraft and its target and an absence of canopy glow increase as sun induced clouding or abrasion induced light scattering, for example, increase with aging canopy materials.

Figure 1:
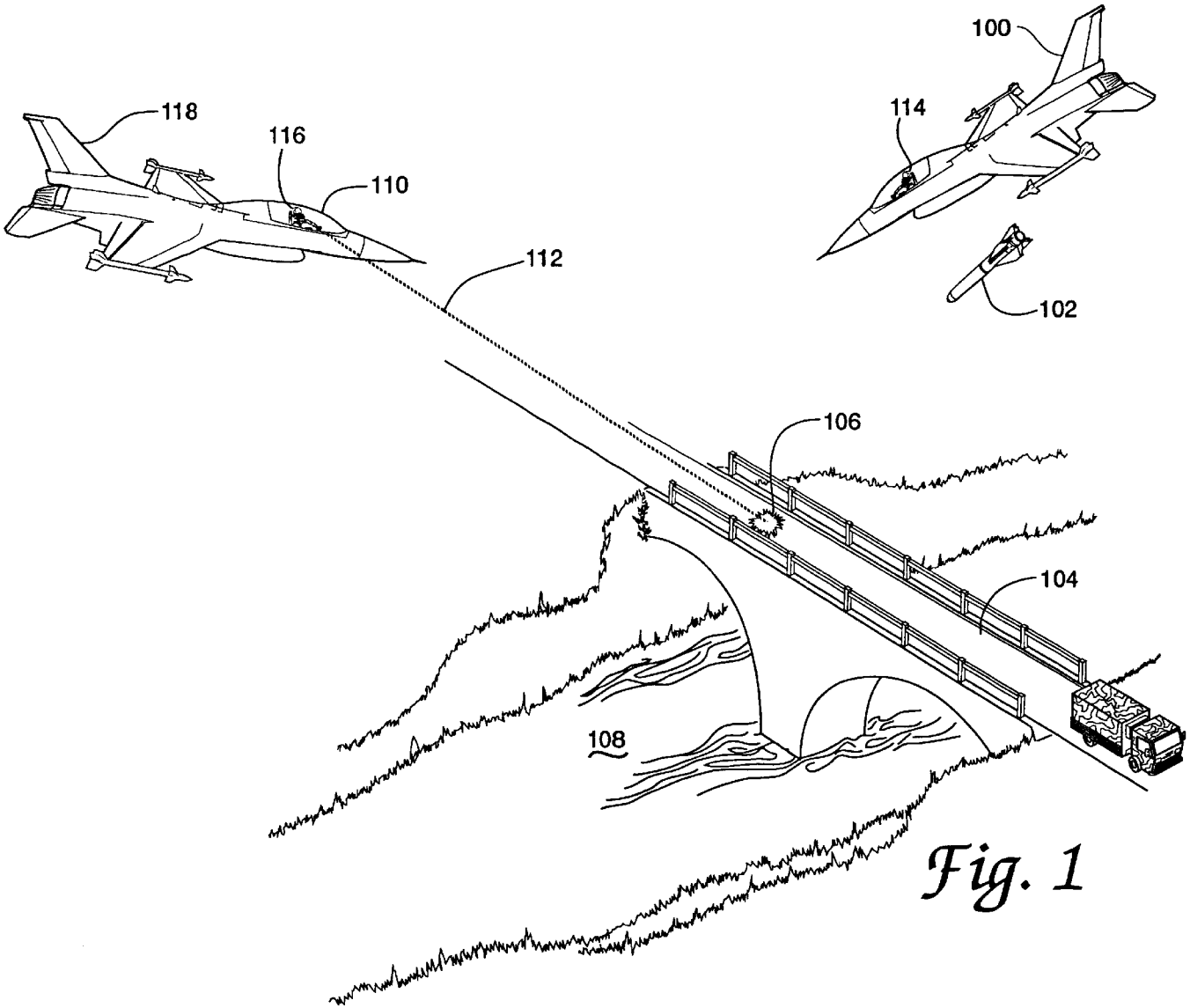
FIG. 1 shows a possible after dark air to ground combat scene in which the present invention is useful.

FIG. 1 in the drawings shows a military action scene in which need for the present invention may arise. In the FIG. 1 drawing a tactical aircraft 100 is represented as having released a munitions device 102, e.g. a smart bomb, and this munitions device is seen homing on a target object represented by the bridge 104 spanning stream 108. The FIG. 1 bridge 104 is being designated as the intended target for the munitions device 102 by a laser beam 112 originating in a hand-held designator operated by the pilot 116 of a second, target designator aircraft 118. The laser beam 112 is transmitted through the canopy 110 of the second aircraft 118 and illuminates a desired munitions impact spot 106 on the bridge 104. The laser beam 112 may provide radiant energy of any desired wavelength, however, a wavelength in the short infra red portion of the energy spectrum is preferable in view of both source availability convenience and atmospheric transmission window considerations. For night missions the pilots 114 and 116 of each aircraft 100 and 118 are presumed to be using night vision goggle apparatus to both operate the aircraft and to observe the target designation accomplished.

Figure 2:
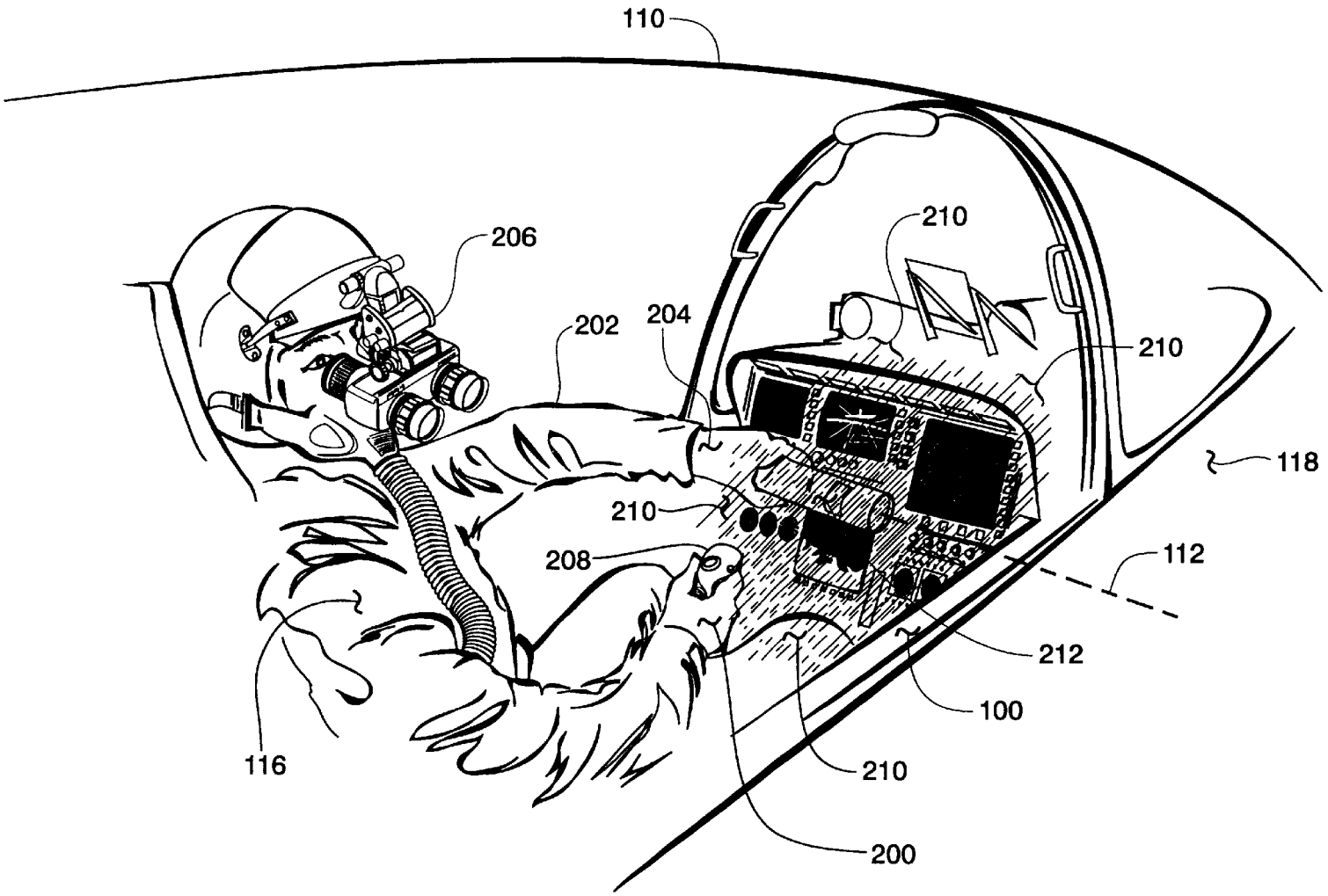
FIG. 2 shows additional aircraft related details of the FIG. 1 combat scene.

FIG. 2 in the drawings shows additional details of the FIG. 1 aircraft 118, the canopy 110, the laser beam 112 and the pilot 116 represented in FIG. 1. The indicator numbers identified in FIG. 1 are reused in FIG. 2 and in each subsequent drawing herein to the best degree possible. In the FIG. 2 drawing therefore the pilot 114 aided by the night vision goggles 206 is shown to be controlling the aircraft 100 with use of right hand 200: on a control stick 208 while simultaneously orienting a target designating laser device 212 with his/her left arm and hand 202 and 204. The FIG. 1 and FIG. 2 laser device 212 may be of a type known in the radiant energy art including specifically a class 4 laser, a laser defined by the American National Standards Institute (ANSI), in standard Z236.1, as a laser having skin burn potential. Alternately, when embodied as a relatively low power solid state device, the laser 212 may be of the laser illuminator type disclosed in the U.S. Patent of our colleagues Jeffrey Craig, Charles Bates, Harry Task and Sheldon Unger in U.S. Pat. No. 5,396,069 issued Mar. 7, 1995. The laser device 212 may also be of the general type disclosed by Melvin C. Ohmer et al. in their U.S. patent applications Ser. No. 9/360,824 and 09/360,825 both filed on Jul. 26, 1999. The inventions of these applications provide laser energy of previously unavailable infrared wavelengths through use of nonlinear optic effects and employment of a new optical material. The contents of this U.S. Patent and these Patent applications are hereby incorporated by reference herein.

The shaded region 210 in the FIG. 2 drawing represents the laser generated veiling canopy glow phenomenon of interest with respect to the present invention. Since the laser device 212 is usually selected to have emission primarily in the infrared spectral region, the glow of region 210 is also primarily disposed in this infrared spectral region. This is of significant concern since the pilot 114 is being aided by the night vision goggles 206, goggles which have major spectral sensitivity also located in the infrared spectral region. Night vision apparatus such as the goggles 206 are readily saturated or overburdened by strong energy input signals as may originate in the veiling canopy glow from region 210. Such goggles often demonstrate the bloom effect frequently noticed, for example, when a television camera scans across a bright object. Notably the veiling canopy glow of region 210 in the FIG. 2 drawing occurs even though the laser device 212 may be provided with a rubber boot, sealing at the laser and canopy interface, to minimize energy leakage. Such non leaked occurrence of the veiling glow can be attributed to a primary origin of the glow within the canopy material rather than from the material surface. The glow from region 210 may also include interference fringe effect patterns.

Nonlinear optical effects attending the material of the canopy 110 in FIG. 2 as well as minor spectral line emissions from the laser device 212 may cause the veiling canopy glow of shaded region 210 to also include sufficient visible spectrum components as to make the region 210 of significant concern even under visual or night vision-unaided flight. conditions. The veiling canopy glow of shaded region 210 is, moreover, not limited to occurrences in the one-piece curved plastic material canopy of the present patent drawings, similar effects are to be expected with the flat windshield elements used in larger aircraft or in other vehicles or in the windows of non vehicle structures when exposed to radiant energy. In fact, to varying degrees the veiling canopy glow effect represented by the FIG. 2 shaded region 210 is also to be expected in the glass or quartz or plastic or other optical materials usable in most window structures. As a minimum for present purposes, therefore, the use of a relatively high energy radiant emission device, such as a laser, within an aircraft cockpit can be expected to incur significant optical difficulties in the nature of undesired radiant emission returns from the cockpit's transparency materials.

Figure 3:
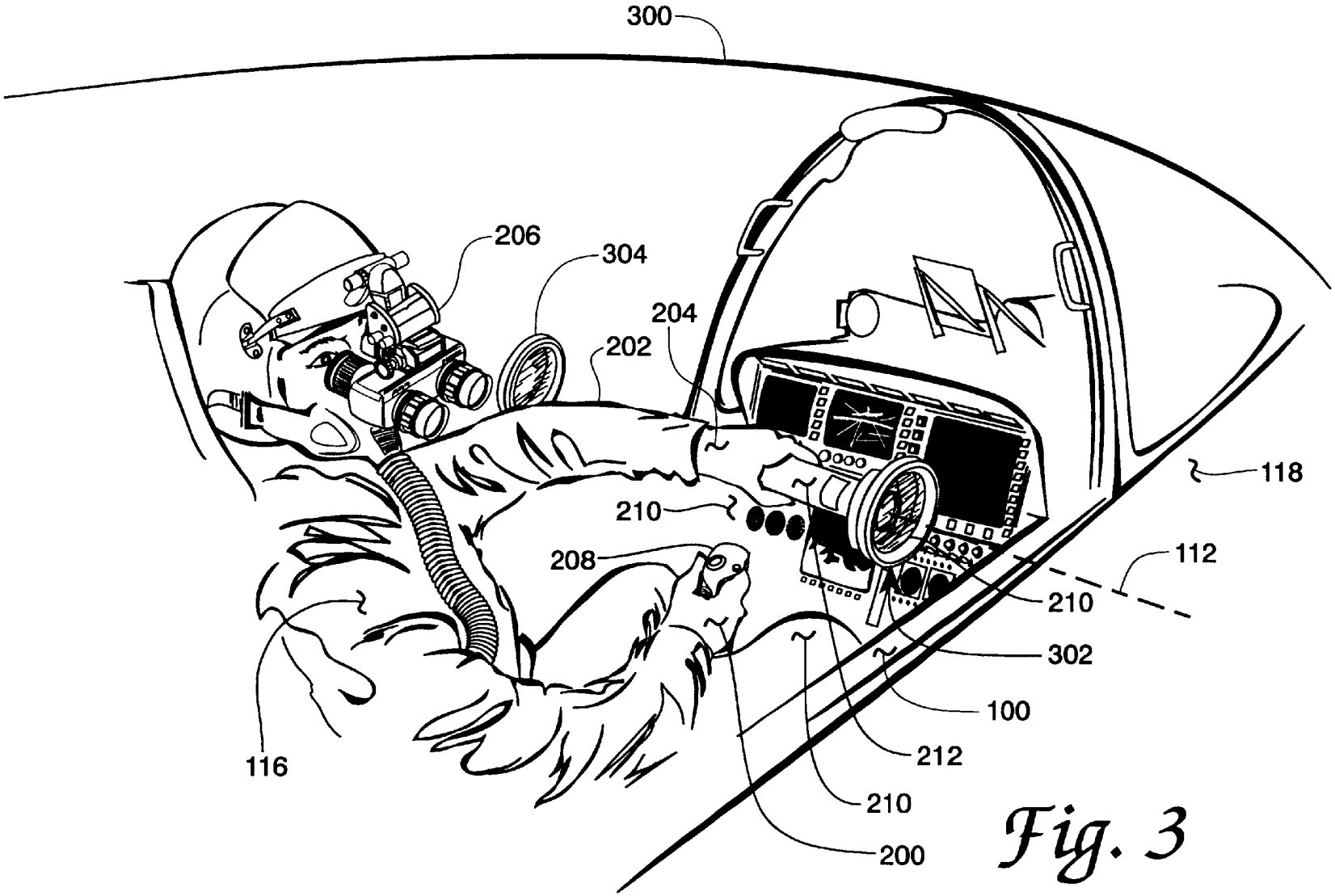
FIG. 3 shows improvement of the FIG. 1 and FIG. 2 combat scenes through use of arrangements according to the present invention.

Once presence of the FIG. 2 veiling canopy glow region 210 is recognized, and considered a problem, it is possible to arrive at a solution to this problem. FIG. 3 in the drawings shows, for example, one useful solution. In the FIG. 3 drawing, the aircraft pilot 116, aided by the night vision goggles 206, is again shown to be controlling the aircraft 118 with use of right hand 200 on control stick 208 while simultaneously determining the orientation of the target designating laser device 212 with his/her left arm and hand 202 and 204. In the FIG. 3 drawing however, the aircraft canopy 300 is provided with a window aperture in the form of a porthole assembly 302 through which the pilot 116 is directing the output energy beam 112 of laser device 212 to illuminate the designated target such as bridge 104 in FIG. 1.

The use of porthole assembly 302 as a window for the beam 112 provides a significant advantage to the FIG. 3 target designation arrangement in comparison with the similar arrangement shown in the FIG. 2 drawing. This advantage may be appreciated by a further consideration of the FIG. 3 drawing and also from the FIG. 7*b* drawing. A more detailed consideration of the FIG. 3 drawing, for example, shows that the veiling canopy glow region 210 is now limited to the relatively small canopy portion enclosed by the periphery of the porthole assembly 302 and therefore the remaining portion of the canopy 300 is now non energy emitting and fully usable by the pilot's night vision goggles 206. A porthole assembly which may be similar to that of assembly 302 but located on an opposite side of the canopy 300 is shown in simplified and representative form at 304 in FIG. 3. This additional porthole assembly 304 allows target designation to occur from either side or possibly simultaneously from both sides of the aircraft 118 (the latter for brief intervals or while the aircraft is flying on "automatic pilot", for example.)

FIG. 7*b* in the drawings further illustrates the improvement achieved in the FIG. 3 drawing from an energy path perspective. As in FIG. 7*a*, discussed above, FIG. 7*b* again shows a crosssection of a plastic aircraft canopy 701 communicating a laser beam 702 from a cockpit side 710 to an outside or ambient side 712 of the canopy 701. The FIG. 7*b* canopy 701 is improved over the conventional FIG. 7*a* canopy by addition of a porthole assembly 703 of the type shown at 302 in FIG. 3; both FIG. 7 canopies are subjected to similar operating conditions. The emerging laser beam 732 in FIG. 7*b* is, therefore, again attenuated with respect to the input beam 702 by the loss mechanisms of Fresnel reflection represented at 722 plus the resulting scatter emissions represented at 718 and 720 and by the total internal reflection losses represented at 724 and 726, for example. Additional FIG. 7*b* scatter losses are again represented at 728 and 730 where the entrance and exit laser beams intercept materials of differing index of refraction. Significantly, however, in the FIG. 7*b* drawing the canopy portions joining or surrounding the porthole assembly 703, the portions at 740 and 742, for example, are isolated from these energy loss mechanisms and are therefore free of the veiling canopy glow phenomenon. The relatively long and unlimited energy loss paths in the FIG. 7*a* drawing, paths which in fact extend all through the canopy 700 material, and the shorter and limited loss paths in FIG. 7*b* are indicators of the improvement achieved with the present invention.

In the FIG. 7*b* drawing the porthole window 746 of the canopy 701 is shown to be surrounded by a circular configured porthole flange assembly 744 which may be of metallic construction as is disclosed in subsequently described drawings of the present document. Alternately, or in addition, the interfacing edges of both the porthole window 746 and the canopy portions joining or surrounding the porthole assembly 703, such as thickness length edges of the canopy portions 740 and 742, may be made optically opaque by the application of black paint or reflective material or other optical energy-blocking coverings. Both this optically opaque covering and the porthole flange assembly 744 therefore insure that each of the total internal reflection energy component 724, the Fresnel reflection energy component 716 and the scatter energy components 718 and 720, are confined to the canopy material portion surrounded by the porthole flange assembly 744 in the FIG. 7*b* structure. Such confinement, when considered from a conservation of energy viewpoint. means that the confined energy components are transduced into energy of some different form, into component heating thermal energy or conveyed to a heat sinking media in most instances. A carefully arranged embodiment of the present invention porthole apparatus may dispense with one of the described opaque flange material and black paint material since one or the other of these arrangements is doubtless sufficient to achieve the desired FIG. 7*b*. confining effect.

Although the FIG. 7*b* laser energy confinement may not appreciably reduce the quantum of laser beam energy lost to the several loss mechanisms, the area of the canopy from which these loss energy components can communicate into the cockpit and night vision goggles 206 is significantly reduced. Therefore major areas of the canopy 300 can again be used for night vision goggle-aided viewing by the pilot 116. With considered sizing, shaping and configuration of the porthole assembly 703, laser energy reflections and other scattered energy effects originating in the laser or in the porthole window 746 within the porthole assembly 703 can be severely limited in a FIG. 3 arrangement of the invention.

The present invention also provides overall improvements in, for example, pilot eye safety and infrared signature of the aircraft.

Figure 4:
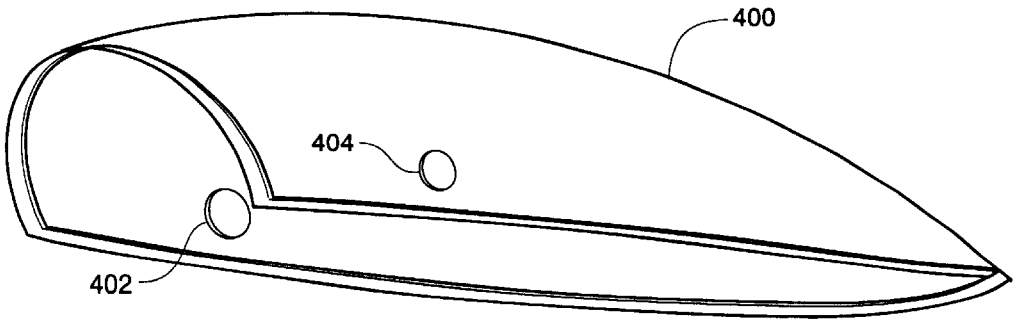
FIG. 4 shows an aircraft canopy of the type usable in FIG. 1–FIG. 3 including canopy arrangements according to the present invention.

FIG. 4 in the drawings shows a perspective view of a canopy 400 for a currently used U.S. Air Force F-16 tactical aircraft as this canopy appears with portholes 402 and 404 according to the present invention included in canopy sidewalls. The FIG. 4 canopy 400 is removed from an aircraft and is shown from a looking up perspective. The canopy porthole apertures 402 and 404 are open and awaiting installation of the porthole flange metal in the FIG. 4 view. The FIG. 4 canopy may include the gold coating currently used for electrostatic and sunlight protection of the pilot and aircraft equipment or may be of the non-tinted plastic material type. As represented in the FIG. 4 drawing the canopy porthole opening 400 has a diameter of, for example, four inches. Canopies of the FIG. 4 type may be made from a variety of materials including a preferred polycarbonate composition.

Although shown as a circular opening in FIG. 3 and FIG. 4 drawings several factors bear consideration in selecting optimum shape and dimensions for a canopy laser porthole according to the invention; among these factors are the porthole size needed for convenient hand positioning and aiming of the laser device, the maintenance of. canopy physical integrity needed for pilot protection and for possible cockpit pressurization, the degree of porthole assembly intrusion into the cockpit accepted by pilots and so on. Additional factors bearing consideration in porthole size and shape selection include the effect a porthole has on bird-impact resistance of the canopy system, the need to maintain a continuous surface electrical conductivity (when canopy coating for static electricity dissipation or antenna use is present) and the ease of retrofitting a canopy porthole kit. The canopy window can be composed of a material different from that of the canopy itself to possibly enhance its infrared transmissivity efficiency and reduce energy losses. The canopy window can also be coated with anti-reflection coatings. The porthole of the invention may additionally be located in portions of the aircraft other than the canopy or in different canopy regions. The porthole intrusion consideration largely results from the presence of canopy curvature together with a need to maintain canopy integrity and possible pressurization and may be better understood from the views of FIG. 5 and FIG. 6 in the drawings along with the following discussion.

Figure 5:
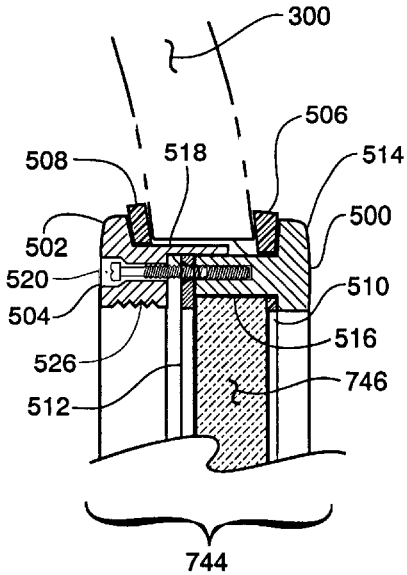
FIG. 5 shows details of an aircraft canopy arrangement capable of accomplishing the present invention.

FIG. 5 in the drawings shows cross sectional details of a laser porthole assembly according to the invention as this assembly may be, for example, mounted in the F-16 canopy of the FIG. 4 drawing. The assembly shown in FIG. 5 may embody the porthole flange assembly 744 appearing in FIG. 7*b*. In the FIG. 5 and FIG. 6 porthole assembly the aircraft canopy is shown at 300, the canopy porthole window at 746, outer and inner metallic (preferably aluminum) mounting rings at 500 and 502, machine screws holding the inner and outer rings in pressured engagement appear at 520 and 522 and ring to canopy sealing gaskets appear at 506 and 508. Also shown in the FIG. 5 drawing are an annular window retainer member 512 which is held in position by the small flat headed machine screws indicated at 518, these machine screws are received in tapped holes within the outer ring member 500 in positions circumferentially displaced from the positions receiving the machine screws 520 and 522. Apertures for passing the machine screws 520 and 522 through window retainer member 512 may be disposed in the retainer member periphery but are omitted in FIG. 5 and FIG. 6 for drawing simplification. The window retainer member 512 serves to maintain the outer ring member 500 and the canopy porthole window 746 as a unitary assembly as in FIG. 5 prior to their final positioning and integration with the ring 502; it may be made of aluminum alloy or other suitable material.

Figure 6:
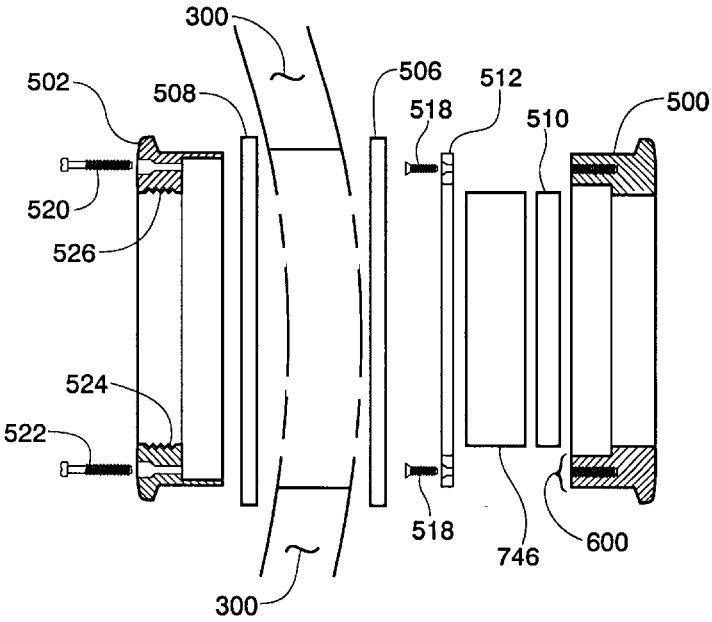
FIG. 6 shows exploded view details of an aircraft canopy arrangement capable of accomplishing the present invention.

FIG. 6 of the drawings shows the porthole assembly of FIG. 5 in an exploded view wherein parts identified in connection with FIG. 5 above become maximally visible. The threads shown at 524 and 526 in the internal diameter of the inner ring 502 in both the FIG. 5 and FIG. 6 drawings are optional in nature but, however, permit leak-free secure engagement of a laser-to-ring rubber boot element for largely excluding spurious return energy (e.g. leakage and energy of the type herein considered, the type represented at 210 in FIG. 3) from the aircraft cockpit. With such a boot the possibly significant glow from the small energized porthole window 746 material is substantially eliminated as a source of night vision goggle noise signal within the aircraft cockpit. The porthole window may of course be fabricated from materials differing from those of the canopy itself in order to minimize this spurious energy return or in order to enhance the infrared transmission capability of the window. In arrangements of the invention employing other than infrared laser energy such a canopy-different window material may be of significant advantage. For a laser or other sources operating in the short ultraviolet wavelength portion of the spectrum, for example, a quartz window material offers desirable energy transmission characteristics.

The FIG. 5 and FIG. 6 drawings also illustrate the concepts of porthole physical protrusion inside and outside of the aircraft when a porthole assembly arrangement is used. Each of these intrusions may in fact be undesirable in a finished product embodiment of the invention, the former for reasons of pilot inconvenience and possible physical hazard, the latter for reasons of aircraft streamline interruption and increased wind resistance or aerodynamic drag and wind noise. Improved window arrangements providing the desired optical isolation together with minimal internal and external protrusion are doubtless within the capability of those skilled in the airframe design art.

The relationship between the outer ring member 500 and the canopy porthole window element at 746 in the FIG. 5 drawing is of interest especially in embodiments of the invention involving higher power laser devices used to perform the target designation function. As noted previously herein the canopy veiling glow phenomenon tends to become more pronounced as the operating power level of the target designating laser is increased. From this relationship it may be concluded that the energy losses occurring during laser energy transmission through the FIG. 5 porthole window 746 increase, possibly nonlinearly, with increasing laser power level. Canopy material transducing of the laser energy to differing wavelengths including wavelengths in the long infrared region can be a factor in this energy loss. Since the outer ring 500 in the FIG. 5 drawing is disposed adjacent the peripheral surface of the porthole window 746 this ring 500 receives a significant portion of the laser energy loss (i.e., the energy resulting from canopy total internal reflection, Fresnel reflection, scatter, particulate inclusions, bubbles, scratches, abrasions and sand or stone impact markings) that is blocked from the remainder of the canopy with the present invention.

If the laser used in the target designating device is of sufficient operating power level the metal ring 500 can by this mechanism receive sufficient energy input to itself be raised in temperature and thereby become a source of night vision goggle noise signal in the cockpit (e.g., the ring being warmer than its surroundings becomes visible in the night vision goggle-viewed scene). Mechanical coupling between the rings 500 and 502 as provided by the machine screws 520 and 522 tends to extend this ring heating sequence to the inner ring 502 where even greater probability of appearance in the night vision goggle scene occurs as a result of ring location. Counteracting this ring heating sequence however is the fact that the outer ring 500 is located in the slipstream of the aircraft and thereby is maintained at near ambient air temperature--even in the presence of laser power levels of tens of watts or more.

One of the FIG. 5 metal rings 500 and 502 will of course inherently be disposed in the aircraft slipstream depending on which is made largest in body diameter, elected for in cockpit disposition and so on; the arrangement shown in FIG. 5 is believed most desirable in this respect since heat conduction through the length of the screws 520:and 522 is not required in order for window 746 heat to reach the aircraft slipstream and a lower operating temperature is thus realized for the internal ring. The relatively large cross sectional area of the ring 500 in the region indicated at 600 in FIG. 6 is desirable not only for providing a reception area for the screws 518, 520 and 522 but also in view of the enhanced thermal conductivity it achieves between the window 746 and the aircraft slipstream. In summary the illustrated disposal of the outer ring 500 nearest the energy loss-source periphery of the canopy porthole window 746 may be appreciated as another advantage attending the FIG. 5 arrangement of the invention.

While the apparatus and method herein described constitute a preferred embodiment of the invention, it is to be understood that the invention is not limited to this precise form of apparatus or method and that changes may be made therein without departing from the scope of the invention which is defined in the appended claims.

What is claimed is:

1. Night vision apparatus-compatible laser beam path window apparatus comprising the combination of:

a first radiant energy transparent member having loss inclusive radiant energy transmission capability in both thickness first and thickness-orthogonal second directions;

a night vision apparatus receiving externally sourced input signal energy through said first radiant energy transparent member;

a second radiant energy transparent member physically smaller in said thickness-orthogonal direction than said first radiant energy transparent member and having loss-inclusive radiant energy transmission capability in both thickness and thickness-orthogonal directions;

said second radiant energy transparent member being coplanar received in a selected thickness-orthogonal direction region of said first radiant energy transparent member;

a hand held laser member having radiant output energy directed through said second radiant energy transparent member in said thickness direction;

said loss inclusive radiant energy transmission capabilities in said first and second radiant energy transparent member being capable of generating, from said thickness direction-oriented laser radiant output energy, energy loss portions having thickness and thickness-orthogonal direction components of orientation;

a geometrically closed radiant energy containment member surrounding said smaller second radiant energy transparent member in said thickness-orthogonal direction and interrupting said radiant energy loss portions having a thickness-orthogonal direction component of orientation intermediate said smaller second radiant energy transparent member and said surrounding first radiant energy transparent member;

said interrupting and said geometrically closed radiant energy containment member limiting radiant energy loss portion-sourced spurious energy emissions from said laser path window apparatus into said night vision apparatus to occurrence in said second radiant energy transparent member in exclusion of larger, and more disabling to said night vision apparatus, occurrences in said first radiant energy transmission member.

2. The night vision apparatu-compatble laser path window apparatus of claim 1 wherein said first radiant energy transparent member and said second radiant energy transparent member comprise an aircraft windscreen. said laser member comprises a handheld target designator apparatus and said second radiant energy transparent member comprises a laser target designator output beam window in said aircraft windscreen.

3. The night vision apparatus-compatible laser path window apparatus of claim 2 wherein said aircraft is a tactical military aircraft and said aircraft windscreen comprises a plastic aircraft canopy member.

4. The night vision apparatus-compatible laser path winddow apparatus of claim 10 wherein said geometrically closed radiant energy containment member comprises an opaque coating over thickness oriented adjacent edge portions of one of said first radiant energy transparent member and said second radiant energy transparent member.

5. The night vision apparatus-compatible laser path window apparatus of claim 1 wherein said geometrically closed radiant energy containment member comprises a metallic structure.

6. The night vision apparatus-compatible laser path wiring apparatus of claim 1 wherein said loss-inclusive radiant energy transmission capability includes an energy loss mechanism comprising one of total internal reflection, Fresnel reflection and scatter-based loss mechanisms.

7. Thee night vision apparatus-compatible laser path window apparatus of claim 1 wherein said radiant energy transmission capability comprises transmission through one of energy dissipating particulate inclusions and bubbles within one of material comprising said first radiant energy transparent member and said second radiant energy transparent member and abrasions received in external surface portions of one of said members materials.

8. The method of limiting aircraft windshield material-sourced, night vision apparatus-interfering, spurious energy emissions originating from a hand manipulated cockpit-housed laser ground area illuminating apparatus, said method comprising the steps of:

directing output energy of said laser ground area illuminating apparatus through a selected limited size portion of said aircraft windshield;

interrupting radially directed energy flow paths tending to originate in said selected limited size portion of said aircraft windshield, extend within said windshield material to remaining windshield portions and entering said cockpit and said night vision apparatus by way of windshield material imperfection energy diffusions;

said windshield material-sourced spurious energy emissions being thereby area limited to emissions originating in said selected limited size portion of said aircraft windshield;

conducting thermal energy portions of said radially directed laser energy originating in said selected limited size portion of said aircraft windshield and extending radially through said windshield material into a sliipstream portion of said aircraft.

9. The method of limiting aircraft windshield material-sourced, night vision apparatus-interfering, spurious energy emissions of claim 8 wherein said step of conducting said radially directed laser energy originating in said selected limited size portion of said aircraft windshield includes conducting said radially directed laser energy into a closed perimeter metallic element disposed between said selected limited size portion of said windshield and remaining portions of said windshield.

10. The method of limiting aircraft windshield material-sourced, night vision apparatus-interfering, spurious energy emissions of claim 9 wherein said metallic element is disposed in a closed circular geometric shape surrounding said selected limited size portion of said windshield.

11. The method of limiting aircraft windshield material-sourced, night vision apparatus-interfering, spurious energy emissions of claim 8 wherein said spurious energy emission radially directed energy flow paths include one of reflection, total internal reflection and scatter-based energy loss mechanisms.

12. The method of limiting aircraft windshield material-sourced, night vision apparatus-interfering, spurious energy emissions of claim 8 wherein said aircraft windshield material-sourced spurious energy emissions include emissions originating in bubbles, particulate inclusions and surface defects attending said aircraft windshield material.

13. Night vision system compatible airborne laser target designator apparatus comprising the combination of:

an aircraft canopy-shaped transparent member having visible and infrared radiant energy transmission capability in both thickness first and thickness-orthogonal second directions and having a loss inclusive radiant energy transmission characteristic in each of said directions;

an infrared laser radiant energy transparent porthole member physically smaller in said thickness-orthogonal direction than said aircraft canopy-shaped transparent member and having. a loss inclusive radiant energy transmission characteristic;

said infrared laser radiant energy transparent porthole member being coplanar received in a selected thickness-orthogonal direction portion of said aircraft canopy-shaped transparent member;

a hand-held infrared laser target designator member having radiant output energy selectively directable through said infrared laser radiant energy transparent porthole member in thickness direction-orientation toward an aircraft-external target;

said loss inclusive radiant energy transmission capability in said laser radiant energy transparent porthole member generating, from said thickness direction-oriented laser target designator member radiant output energy, energy loss portions having night vision system noise signal-generating characteristics;

a geometrically closed optically opaque radiant energy containment assembly surrounding said infrared laser radiant energy transparent porthole member in said thickness-orthogonal direction and interrupting said radiant energy loss portions having a thickness-orthogonal direction component of orientation and night vision system noise signal-generating characteristics intermediate said infrared laser radiant energy transparent porthole member and surrounding portions of said aircraft canopy-shaped transparent member;

said noise signal-generating interruption and said geometrically closed optically opaque radiant energy containment assembly limiting radiant energy loss portion-sourced spurious energy emissions and said night vision system noise signals to origination in said radiant energy transparent porthole member in exclusion of larger area originations in surrounding portions of said aircraft canopy-shaped transparent member.

14. The night vision system compatible airborne laser target designator apparatus of claim 13 wherein said geometrically closed radiant energy containment assembly includes one of an opaque coating on an edge portion of one of said radiant energy transparent porthole member and said aircraft canopy-shaped transparent member at a porthole edge-adjacent interface portion thereof and a metallic enclosure ring member also disposed at said porthole edge-adjacent interface portion.

15. The method of interference free compatible operation of a handheld infrared laser and a night vision apparatus within a transparent material-enclosed aircraft cockpit, said method comprising the steps of:

directing an output beam of said handheld infrared laser through a designated area of said transparent material cockpit enclosure of said aircraft to a selected illumination target;

interrupting laser energy flow from said designated area of said transparent material cockpit enclosure through energy dispersing imperfection-inclusive cross sectional thickness portions of said cockpit enclosure transparent material and into said cockpit and said night vision apparatus;

said interrupting step including isolating said designated area of said transparent material cockpit enclosure from remainder portions of said enclosure with a designated area-surrounding closed circumference metallic member disposed in coplanar relationship with said designated area and said enclosure remainder portions;

dissipating interrupted laser energy by exposing a portion of said designated area-surrounding closed circumference metallic member to a thermal energy dissipating slipstream of said aircraft.

* * * * *